US005586628A

United States Patent [19]

Wang

[11] Patent Number: 5,586,628

[45] **Date of Patent: *Dec. 24, 1996**

[54] STRUCTURE OF A TELESCOPIC HANDLE FOR WHEELED LUGGAGE

[76] Inventor: Yuan L. Wang, P.O. Box 82-144, Taipei, Taiwan

[ * ] Notice: The term of this patent shall not extend beyond the expiration date of Pat. No. 5,393,079.

[21] Appl. No.: 463,769

[22] Filed: Jun. 5, 1995

Related U.S. Application Data

[63] Continuation-in-part of Ser. No. 363,946, Dec. 27, 1994.

[51] Int. Cl.[6] ..... A45C 13/26; A45C 5/14

[52] U.S. Cl. ..... 190/115; 190/18 A; 190/39; 16/115

[58] Field of Search ..... 190/18 A, 39, 190/115, 117; 16/115; 280/37, 655, 655.1, 47.29

[56] References Cited

U.S. PATENT DOCUMENTS

| | | | |
|---|---|---|---|
| 4,348,034 | 9/1982 | Welt | 280/655 X |
| 4,478,429 | 10/1984 | Adams | 280/655 |
| 4,546,995 | 10/1985 | Kassai | 280/655 |
| 4,896,897 | 6/1990 | Wilhelm | 280/47.2 X |
| 4,995,487 | 2/1991 | Plath | 190/18 A |
| 5,323,886 | 6/1994 | Chen | 190/18 A |
| 5,374,073 | 12/1994 | Hung-Hsin | 16/115 X |
| 5,393,079 | 2/1995 | Wang | 190/18 A X |

*Primary Examiner*—Sue A. Weaver
*Attorney, Agent, or Firm*—Alfred Lei

[57] ABSTRACT

A telescopic handle for wheeled luggage includes a pair of sleeves fixedly mounted on an upper panel of a wheeled luggage, a pair of outer tubes connected with the sleeves, a pair of inner tubes fitted in the outer tubes, a pair of tubular members inserted into the inner tubes, an inverted U-shaped member having two downwardly depending legs inserted into the inner tubes, a pair of first plugs engaged with the lower ends of the inverted U-shaped member, and a pair of second plugs engaged with the inner tubes, whereby the telescopic handle will not retract into the inner tubes unintentionally.

3 Claims, 5 Drawing Sheets

STRUCTURE OF A TELESCOPIC HANDLE FOR WHEELED LUGGAGE

CROSS-REFERENCE

This is a continuation-in-part of application Ser. No. 08/363,946, filed Dec. 27, 1994, now pending.

BACKGROUND OF THE INVENTION

1. Field of the Invention

This invention relates to an improvement in the structure of a telescopic handle for wheeled luggage in particular to one which can be prevent a telescopic handle from retracting unintentionally.

2. Description of the Prior Art

It has been found that the conventional telescopic handle of wheeled luggage will often retract downwardly when the articles contained in the wheeled luggage A (see FIG. 6) exceeds a predetermined value thereby causing much inconvenience in use.

Therefore, it is an object of the present invention to provide an improvement in the structure of a telescopic handle for wheeled luggage which can obviate and mitigate the above-mentioned drawbacks.

SUMMARY OF THE INVENTION

This invention relates to an improvement in the structure of a telescopic handle for wheeled luggage.

It is the primary object of the present invention to provide an improvement in the structure of a telescopic handle for wheeled luggage which can prevent a telescopic handle from retracting unintentionally.

It is another object of the present invention to provide an improvement in the structure of a telescopic handle for wheeled luggage which is easy to manufacture.

It is still another object of the present invention to provide an improvement in the structure of a telescopic handle for wheeled luggage which is simple in construction.

It is still another object of the present invention to provide an improvement in the structure of a telescopic handle for wheeled luggage which is facile to assemble.

It is a further object of the present invention to provide an improvement in the structure of a telescopic handle for wheeled luggage which is practical in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

FIG, 1 is a sectional exploded view of the present invention;

FIG, 2 is a partly broken perspective view of another preferred embodiment of the first plug and the second plug;

Figure 4:
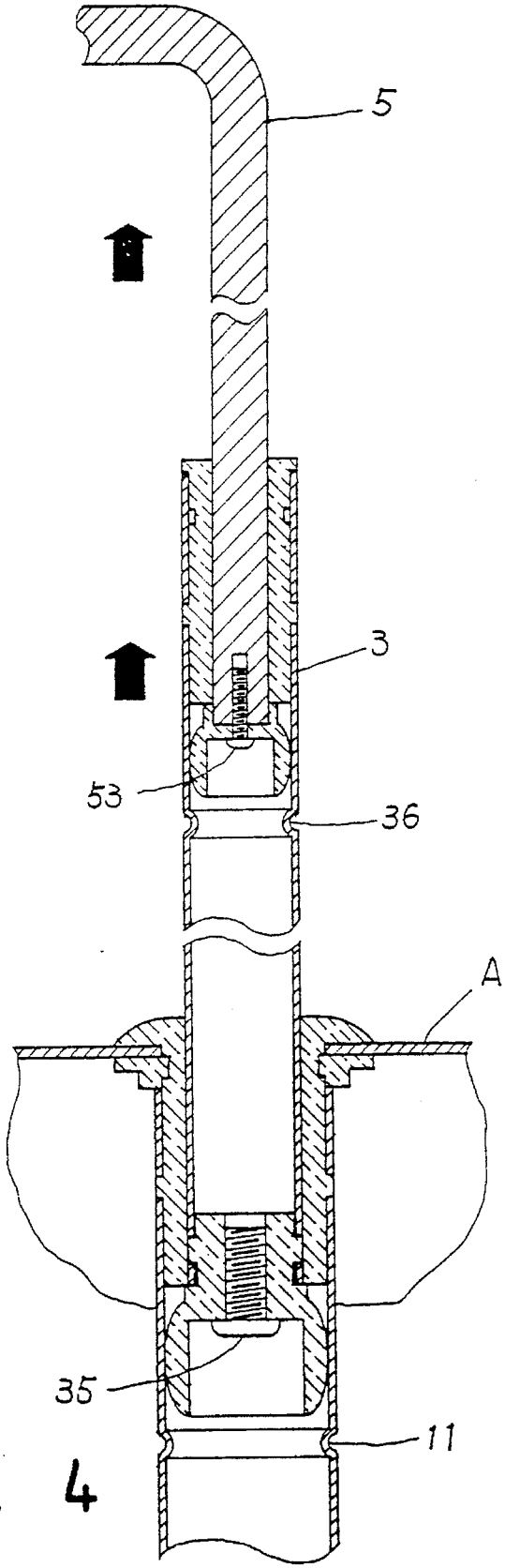
Figure 5:
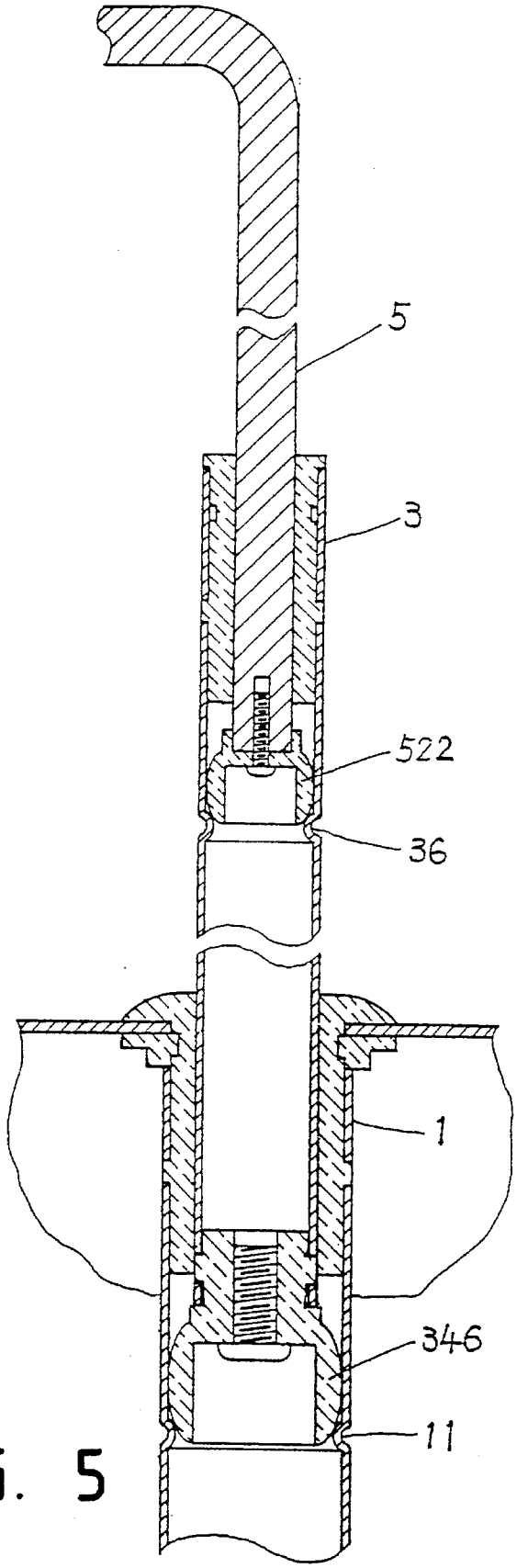
Figure 6:
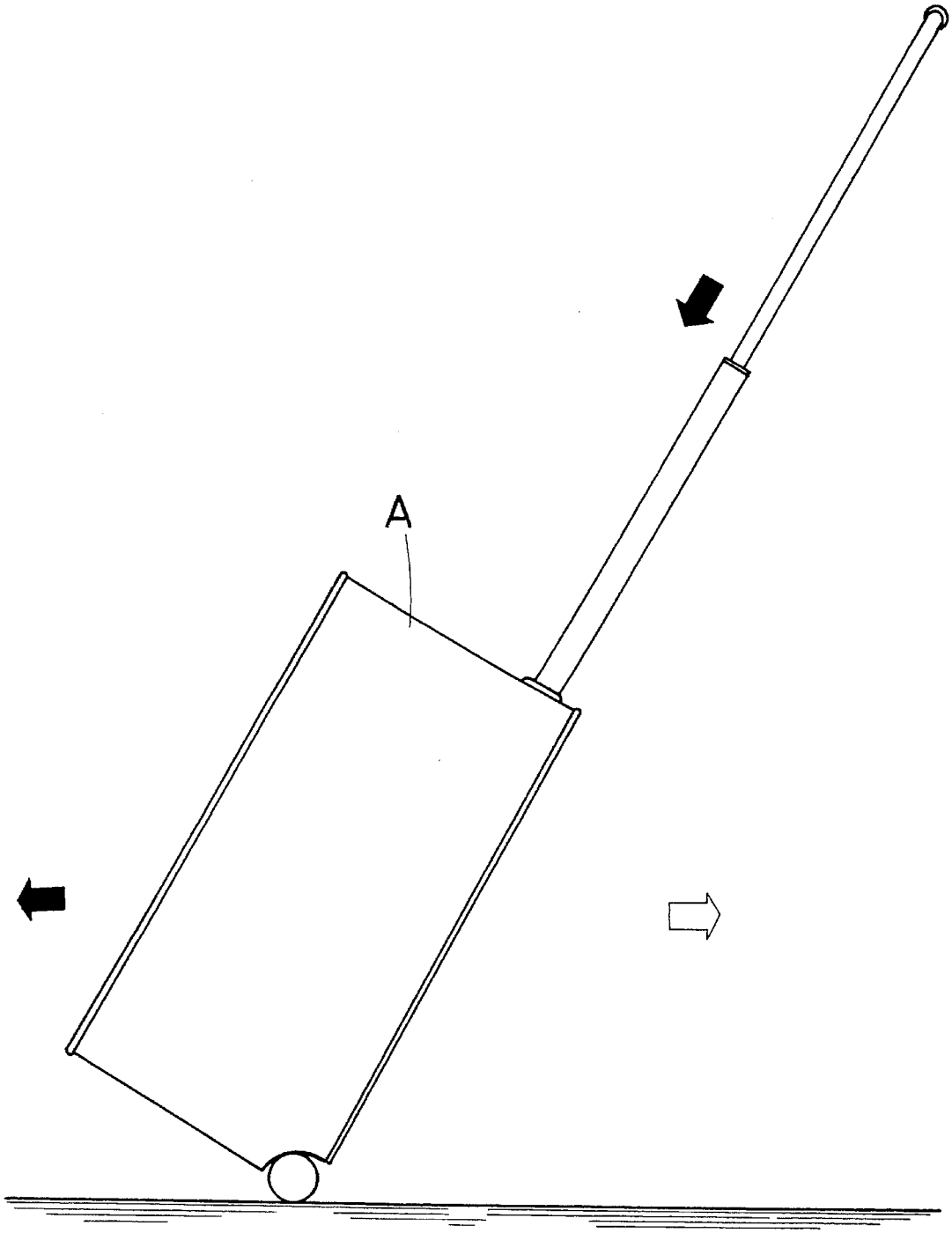
PRIOR ART FIG. 6

FIG, 3 shows another preferred embodiment of the circular projections of the inner tube and the outer tube;

FIGS. 4 and 5 are sectional views illustrating the working principle of the present invention, and FIG. 6 illustrates a prior art wheeled luggage piece.

DETAILED DESCRIPTION OF THE PREFERRED EMBODIMENT

For the purpose of promoting an understanding of the principles of the invention, reference will now be made to the embodiment illustrated in the drawings. Specific language will be used to describe the same. It will, nevertheless, be understood that no limitation of the scope of the invention is thereby intended, such alternatives and further modifications in the illustrated device, and such further applications of the principles of the invention as illustrated herein being contemplated as would normally occur to one skilled in the art to which the invention relates.

Figure 1:
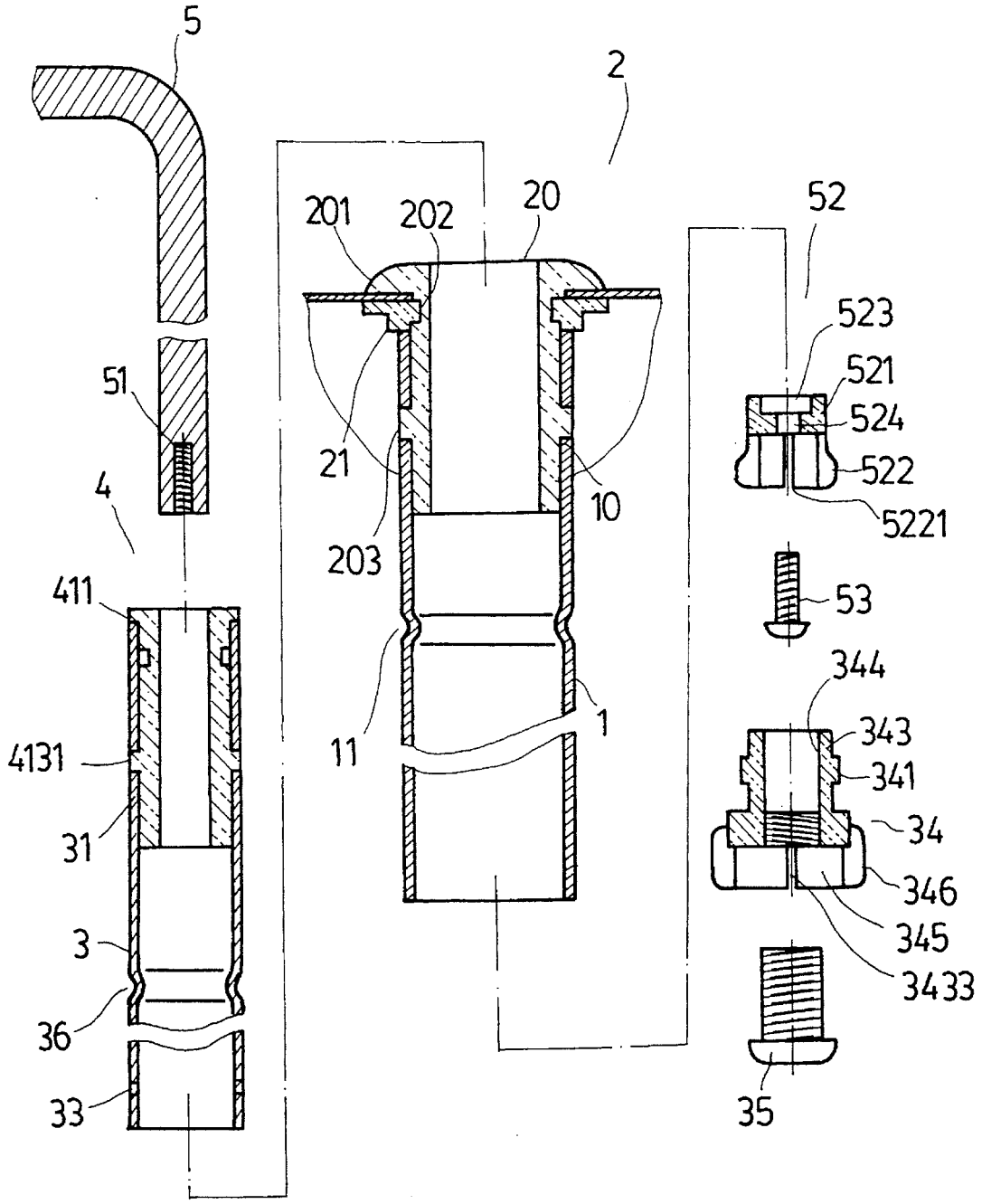

With reference to the drawings and in particular to FIG. 1 thereof, the telescopic handle for a wheeled luggage piece according to the present invention mainly comprises an inverted U-shaped member 5, a pair of outer tubes 1 (only one is shown), a pair of sleeves 2 (only one is shown), a pair of inner tubes 3 (only one is shown), a pair of tubular members 4 (only one is shown), a pair of first plugs 52 (only one is shown) and a second pair of plugs 34 (only one is shown).

The sleeve 2 includes a tubular portion having a axial hole 20, a flange 201 at the upper end, an annular groove 202 under the flange 201, and a pair of protuberances 203 under the groove 202. The sleeve 2 is mounted within receiving holes formed on the upper panel of the wheeled luggage, with its flange 201 located thereon. A retainer ring 21 is engaged with the groove 202 of the sleeve 2 so as to keep the sleeve 2 in a fixed position.

Figure 3:
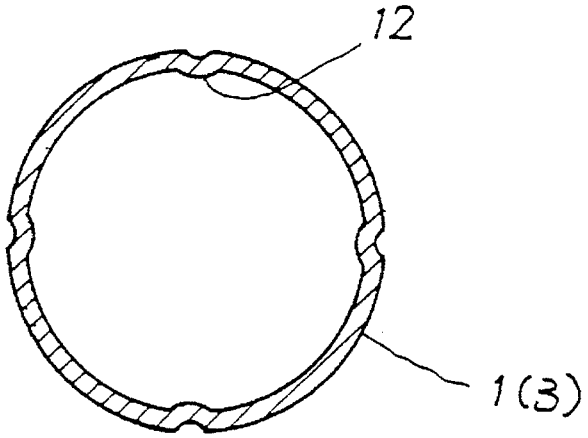

The outer tube 1 is formed with a pair of first holes 10 adapted to receive the protuberances 203 of the sleeve 2 and a circular projection 11 on its inner surface under the holes 10. Further, the circular projection 11 may be replaced with protrusions 12 shown in FIG. 3.

The inner tube 3 is formed with a pair of second holes 31, a circular projection 36 under the holes 31 on its inner surface, and a pair of third holes 33 under the circular projection 36. The inner tube 3 is inserted into the outer tube 1 through the hole 20 of the sleeve 2. Further, the circular projection 36 may be replaced with protrusions 12 shown in FIG. 3.

The tubular member 4 has a flange 411 at its upper end and a pair of protuberances 413 under the flange 411. The tubular member 4 is inserted into the inner tube 3, with the flange 411 on the upper end of the inner tube 3 and the protuberances 413 engaged with the holes 31.

The inverted U-shaped member 5 has two downwardly depending legs each formed with a threaded hole 51 at the lower end. Each leg of the inverted U-shaped member 5 is inserted into the inner tube 3 through the tubular member 4.

Figure 2:
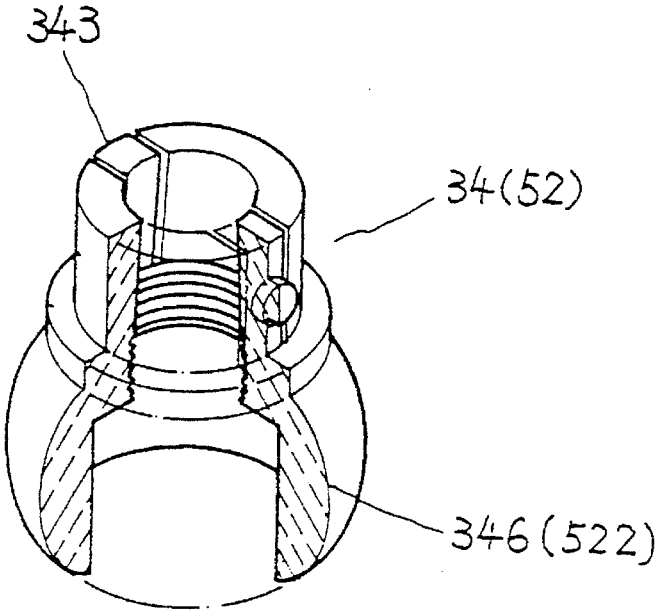

The first plug 52 includes a cylindrical portion 521 having a cavity 523 at the upper end adapted to receive the lower end of the leg of the inverted U-shaped member 5, a center hole 524, and a plurality of slits 5221 at the lower portion 522. The lower portion 522 is formed with a flange the outer diameter of which is slightly larger than the inner diameter of the inner tube 3. Further, the first plug 52 may be formed with a curved flange, as shown in FIG. 2.

A screw 53 extends upwardly through the center hole 254 of the first plug to engage with the threaded hole 51 of the inverted U-shaped member 5.

The second plug 34 includes a cylindrical portion 343 having a divergent center hole 344 with internal threads 345, a pair of protuberances 341 adapted to engage with the holes 33 of the inner tube 3, and a plurality of slits 3433 at the lower portion 346. The lower portion 346 is formed with a flange the outer diameter of which is slightly larger than the inner diameter of the outer tube 1. In addition, the second plug 34 may be formed with a curved flange, as illustrated in FIG. 2.

A second screw 35 extends upwardly to engage with the internal threads 345 of the center hole 344 of the second plug 34.

FIGS. 4 and 5 illustrate the working principles of the present invention. As illustrated, the circular projections 36 of the inner tube 3 and the circular projections 11 of the outer tube 1 will prevent the lower portion 522 of the first plug 52 and the lower portion 346 of the second plug 34 from going downwardly into the inner tube 3 and the outer tube 1 unintentionally.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A telescopic handle for a wheeled luggage piece comprising:

a pair of sleeves each including a tubular portion having an axial hole, a flange at an upper end, an external annular groove under said flange, and a pair of external protuberances under said groove, said sleeves being mounted on an upper panel of a wheeled luggage piece with said flange located on said upper panel and fixedly kept in place by a retainer engaged with said external groove below said upper panel;

a pair of outer tubes each formed with a pair of holes aligned with said external protuberances and adapted to receive said protuberances when extended over one of said sleeves, said outer tubes further having a circular projection on an inner surface under said holes;

a pair of inner tubes each formed with a pair of first holes, a circular projection on an inner surface under said first holes, and a pair of second holes under said circular projection;

a pair of tubular members each having a flange at an upper end and a pair of external protuberances under said flange of said tubular member aligned with said first holes of said inner tube, each of said tubular members being inserted into one of said inner tubes with said flange of said tubular member on an upper end of said inner tube and said external protuberances of said tubular member engaged with said first holes of said inner tube;

an inverted U-shaped member having two downwardly depending legs each formed at a lower end with a threaded axial hole, each of said legs being inserted into one of said inner tubes through said tubular members;

a pair of first plugs each including a cylindrical portion having a cavity at an upper end dimensioned to receive a lower end of said leg of said inverted U-shaped member, a center hole, and a plurality of slits at a lower portion;

a pair of first screws each extending upwardly through the center hole of each of said first plugs to engage with the threaded axial hole of one of said legs of said inverted U-shaped member;

a pair of second plugs each including a cylindrical portion having a divergent center hole with internal threads, a pair of external protuberances aligned with said second holes and adapted to engage with said second holes of one of said inner tubes, and a plurality of axial slits at a lower portion; and a pair of second screws each extending upwardly to engage with said divergent center hole of each of said second plugs.

2. The telescopic handle as claimed in claim 1, wherein said first and second plugs are provided with a curved flange convexing outward with respect to an axis thereof.

3. The telescopic handle as claimed in claim 1, wherein said circular projection of said outer tubes and said circular projection of said inner tubes are replaced with a plurality of protrusions.

* * * * *